US010422090B2

(12) United States Patent
Maus et al.

(10) Patent No.: US 10,422,090 B2
(45) **Date of Patent: *Sep. 24, 2019**

(54) TRAFFIC CONE

(71) Applicant: TRAFFIX DEVICES, INC., San Clemente, CA (US)

(72) Inventors: Geoffrey B. Maus, Mission Viejo, CA (US); Jeremy Smith, San Clemente, CA (US); Jack H. Kulp, Dana Point, CA (US); Brent M. Kulp, San Clemente, CA (US)

(73) Assignee: TRAFFIX DEVICES, INC., San Clemente, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/788,272

(22) Filed: Oct. 19, 2017

(65) Prior Publication Data

US 2018/0112365 A1 Apr. 26, 2018

Related U.S. Application Data

(63) Continuation of application No. 14/691,513, filed on Apr. 20, 2015, now Pat. No. 9,797,102.
(Continued)

(51) Int. Cl.
*E01F 9/654* (2016.01)
*E01F 9/688* (2016.01)

(52) U.S. Cl.
CPC ..... *E01F 9/654* (2016.02); *E01F 9/688* (2016.02)

(58) Field of Classification Search
CPC ..... E01F 9/654; E01F 9/688
(Continued)

(56) References Cited

U.S. PATENT DOCUMENTS 3,451,368 A 6/1969 Keats
3,705,566 A 12/1972 Duckett et al.
(Continued)

FOREIGN PATENT DOCUMENTS

EP 1626125 A2 1/2006
GB 981074 A 1/1965
(Continued)

OTHER PUBLICATIONS

International Search Report and Written Opinion dated Jul. 24, 2015 for corresponding International App. No. PCT/US2015/026726.
(Continued)

*Primary Examiner* — Peter J Macchiarolo
*Assistant Examiner* — Irving A Campbell
(74) *Attorney, Agent, or Firm* — Stout, Uxa & Buyan, LLP; Donald E. Stout

(57) ABSTRACT

A two-piece traffic marker assembly a marker body includes a marker body formed of a low density polyethylene and a separable molded rubber base. The base has a weight comprising at least 70% of a total weight of the traffic marker assembly, with the marker body having a weight comprising the remaining 30% or less of the total weight of the traffic marker assembly. Because of this advantageous weight distribution, relative to prior art traffic cones, when the traffic marker assembly is assembled, a tip angle of the traffic marker assembly is about 76 degrees from vertical. A plurality of circumferentially spaced interlocking protrusions disposed on the wall of the marker body, for engaging an interior circumference of the base when the marker assembly is in an assembled space, and for also preventing sticking of marker bodies together when they are stacked.

20 Claims, 10 Drawing Sheets

Related U.S. Application Data

(60) Provisional application No. 61/982,293, filed on Apr. 21, 2014.

(58) Field of Classification Search
USPC ..... 116/63 P, 63 C
See application file for complete search history.

(56) References Cited

U.S. PATENT DOCUMENTS

| | | | | |
|---|---|---|---|---|
| 3,952,690 | A | 4/1976 | Rizzo et al. | |
| 4,889,067 | A | 12/1989 | Provence, Jr. | |
| 5,234,280 | A | 8/1993 | Cowan | |
| 5,713,694 | A | 2/1998 | Monda et al. | |
| 5,775,833 | A | 7/1998 | Little | |
| 6,182,600 | B1 | 2/2001 | Brown et al. | |
| 6,186,699 | B1 | 2/2001 | Kulp et al. | |
| 7,513,212 | B2 | 4/2009 | Dvoracek | |
| 9,797,102 | B2 * | 10/2017 | Maus et al. | E01F 9/688 |
| 2005/0025568 | A1 | 2/2005 | Mettler et al. | |
| 2006/0016383 | A1 | 1/2006 | Flamingo et al. | |
| 2012/0234228 | A1 | 9/2012 | Kuo | |

FOREIGN PATENT DOCUMENTS

| | | | |
|---|---|---|---|
| GB | 1378954 | A | 1/1975 |
| GB | 2513676 | A | 11/2014 |
| JP | S4834084 | Y1 | 10/1973 |
| JP | 2005163312 | A | 6/2005 |
| JP | 2005220650 | A | 8/2005 |
| TW | 200936847 | A | 9/2009 |
| WO | 0188275 | A1 | 11/2001 |
| WO | 2006126787 | A1 | 11/2006 |

OTHER PUBLICATIONS

Extended European Search Report dated Dec. 6, 2017 in connection with corresponding EPO App. No. 15783457.3.

* cited by examiner

TRAFFIC CONE

This application is a continuation under 35 U.S.C. 120 of U.S. patent application Ser. No. 14/691,513, entitled Traffic Cone and filed on Apr. 20, 2015, now allowed and issuing as U.S. Pat. No. 9,797,102 on Oct. 24, 2017, which in turn claims the benefit under 35 U.S.C. 119(e) of the filing date of Provisional U.S. Application Ser. No. 61/982,293, entitled Traffic Cone, filed on Apr. 21, 2014. The foregoing commonly assigned applications are expressly incorporated herein by reference, in their entirety.

BACKGROUND OF THE INVENTION

The present invention relates generally to traffic marker devices or safety cones used to alert or divert vehicles, pedestrians, and the like, and more particularly to traffic cones having a molded body and a molded base.

A traffic marker device of the general type contemplated herein is disclosed in U.S. Pat. No. 7,513,212 to Dvoracek, which patent is herein expressly incorporated by reference, in its entirety.

SUMMARY OF THE INVENTION

The present invention is related to a traffic marker assembly, such as a two-piece traffic cone, which comprises a marker body comprising walls formed of molded plastic, a top portion, and a base portion. The base portion comprises a circumferential flange and a base comprising a molded material and having a center aperture therein for receiving the marker body when the marker body is joined to the base. The circumferential flange of the marker body has a greater diameter than a diameter of the center aperture of the base, so that the marker body can be removably joined to the base to form the traffic marker assembly. Advantageously, the base has a weight comprising at least 70% of a total weight of the traffic marker assembly, with the marker body having a weight comprising the remaining 30% of the total weight of the traffic marker assembly. Because of this advantageous weight distribution, relative to prior art traffic cones, when the traffic marker assembly is assembled, a tip angle of the traffic marker assembly is at least 60 degrees from vertical, meaning that the traffic marker assembly remains stable until it has traveled through an angle of greater than 60 degrees from the vertical. Preferably, the tip angle is at least 70 degrees from vertical, and in one particular embodiment, the tip angle is approximately 76 degrees from vertical.

The base, in that same embodiment, has a weight comprising approximately 80% of the total weight of the traffic marker assembly.

The marker body is preferably molded of low density polyethylene, and the base is preferably molded of recycled rubber. Another advantageous feature of the invention are a plurality of circumferentially spaced interlocking protrusions disposed on the wall of the marker body, the interlocking protrusions being located so that they engage an interior circumference of the base when the marker assembly is in an assembled space. The plurality of circumferentially spaced interlocking protrusions are also located so that when a plurality of the marker bodies, without attached bases, are stacked together, the protrusions on a lower marker body interferingly contact an inner wall of a marker body stacked thereover in order to stop further advancement of the upper marker body over the lower marker body, thereby preventing sticking of the upper marker body on the lower marker body.

Additionally, the marker body is also provided with a plurality of diamond-shaped protrusions disposed in spaced circumferential relation about the marker body, each of the diamond-shaped protrusions being disposed between adjacent interlocking protrusions, wherein the diamond-shaped protrusions function to press the base away from the marker body, thereby causing the base to deform toward the interlocking protrusions to improve locking of the base to the marker body, both axially and rotationally.

Still another advantageous feature of the present invention is the provision of a concave recess molded into the top portion of the marker body, for assisting in gripping of the marker body. A protruding circumferential up stop portion molded into the marker body above the concave recess functions to stop a user's hand from slipping off of the top of the marker body while gripping the body. Another approach to prevent such slippage is that the surface of the marker body wall in the top portion may be textured for providing an improved gripping surface.

In another aspect of the invention, there is provided a traffic marker assembly which comprises a marker body comprising walls formed of molded plastic, a top portion, and a base portion, wherein the base portion comprises a circumferential flange. A base is also provided, which comprises a molded material and has a center aperture therein for receiving the marker body when the marker body is joined to the base. The circumferential flange of the marker body has a greater diameter than a diameter of the center aperture of the base, so that the marker body can be removably joined to the base to form the traffic marker assembly.

A plurality of circumferentially spaced interlocking protrusions are disposed on the wall of the marker body, the interlocking protrusions being located so that they engage an interior circumference of the base when the marker assembly is in an assembled state. The plurality of circumferentially spaced interlocking protrusions are also located so that when a plurality of the marker bodies, without attached bases, are stacked together, the protrusions on a lower marker body interferingly contact an inner wall of a marker body stacked thereover in order to stop further advancement of the upper marker body over the lower marker body, thereby preventing sticking of the upper marker body on the lower marker body.

A plurality of diamond-shaped protrusions are also disposed in spaced circumferential relation about the marker body, each diamond-shaped protrusion being disposed between adjacent interlocking protrusions, wherein the diamond-shaped protrusions function to press the base away from the marker body, thereby causing the base to deform toward the interlocking protrusions to improve locking of the base to the marker body, both axially and rotationally.

Advantageously, a concave recess may be molded into the top portion of the marker body, for assisting in gripping of the marker body. The recess may be accompanied by a protruding circumferential up stop portion molded into the marker body above the concave recess. Alternatively, or in addition thereto, the surface of the marker body wall in the top portion is textured for providing an improved gripping surface.

Another advantageous feature of the invention is that the base has a weight comprising at least 70% of a total weight of the traffic marker assembly, the marker body having a weight comprising the remaining 30% of the total weight of the traffic marker assembly, whereby when the traffic marker assembly is assembled, a tip angle of the traffic marker assembly is at least 60 degrees from vertical. In one preferred embodiment, the tip angle is approximately 76 degrees from vertical. The base, in that same embodiment, has a weight comprising approximately 80% of the total weight of the traffic marker assembly.

The marker body is preferably molded of low density polyethylene.

The invention, together with additional features and advantages thereof, may best be understood by reference to the following description taken in conjunction with the accompanying illustrative drawings.

DETAILED DESCRIPTION OF THE INVENTION

Figure 1:
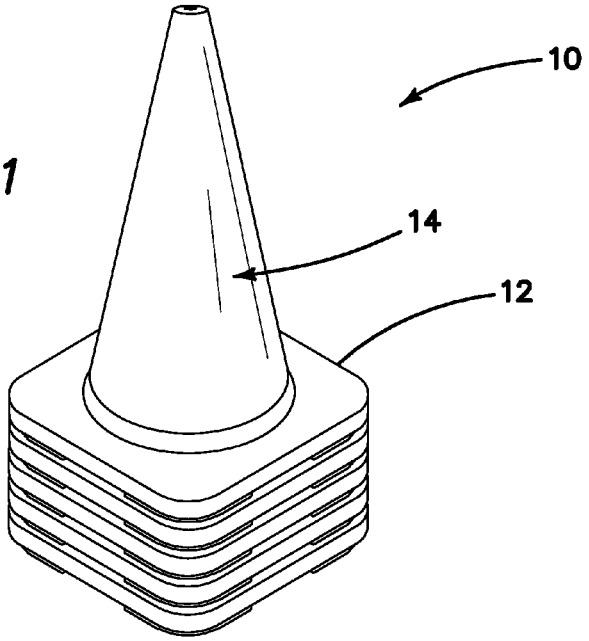
FIG. 1 is an isometric view of a stack of assembled traffic cones constructed in accordance with one embodiment of the present invention.
Figure 2:
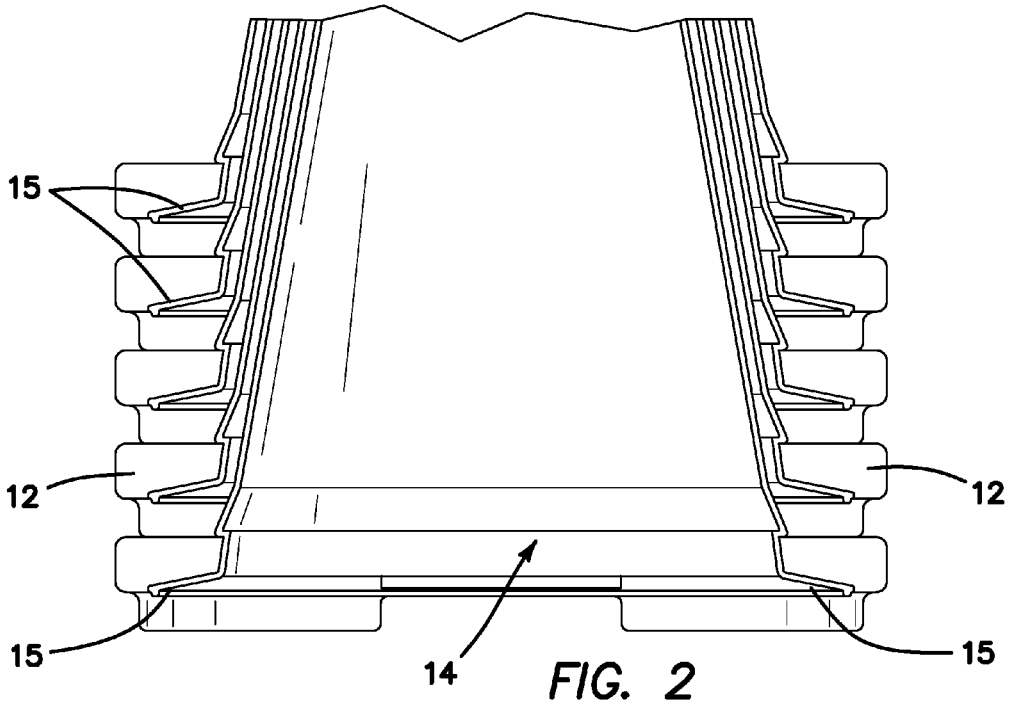
FIG. 2 is a cross-sectional view of the stack of traffic cones of FIG. 1.
Figure 3:
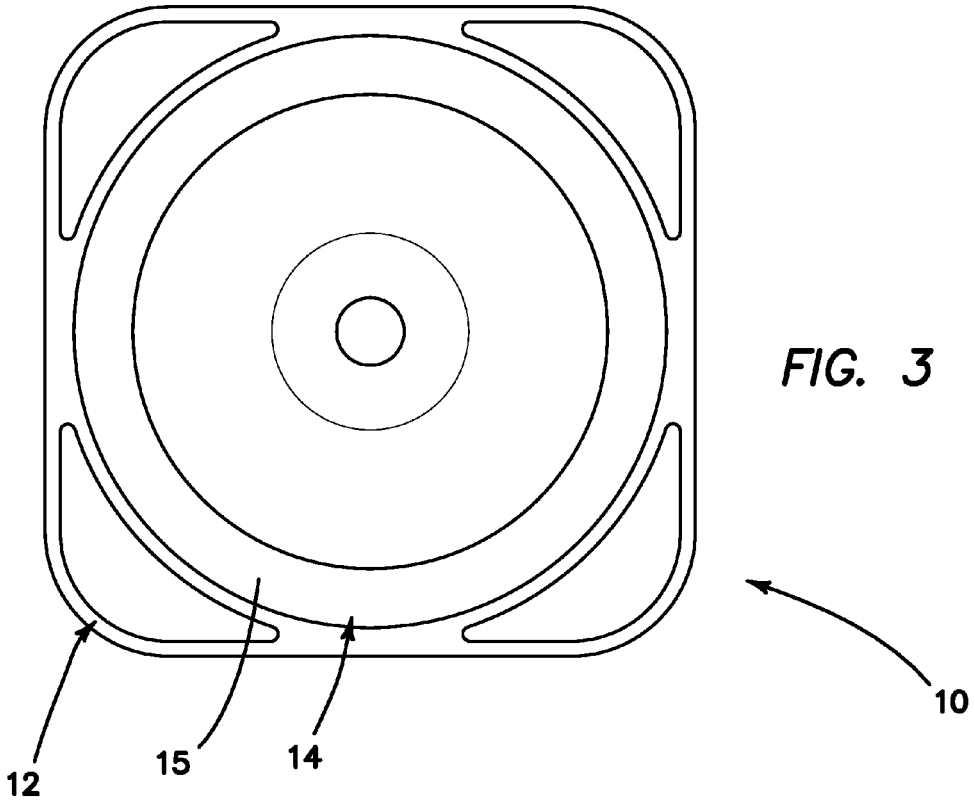
FIG. 3 is a bottom view of the assembled traffic cone of FIG. 1.
Figure 4:
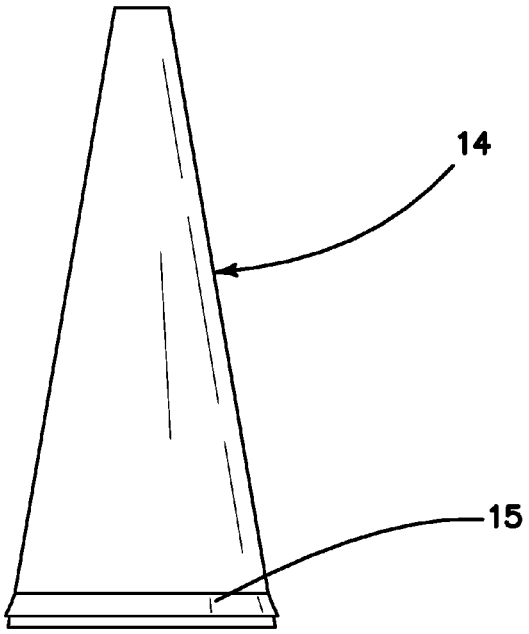
FIG. 4 is a side view of the body portion of the traffic cone of FIG. 1.
Figure 5:
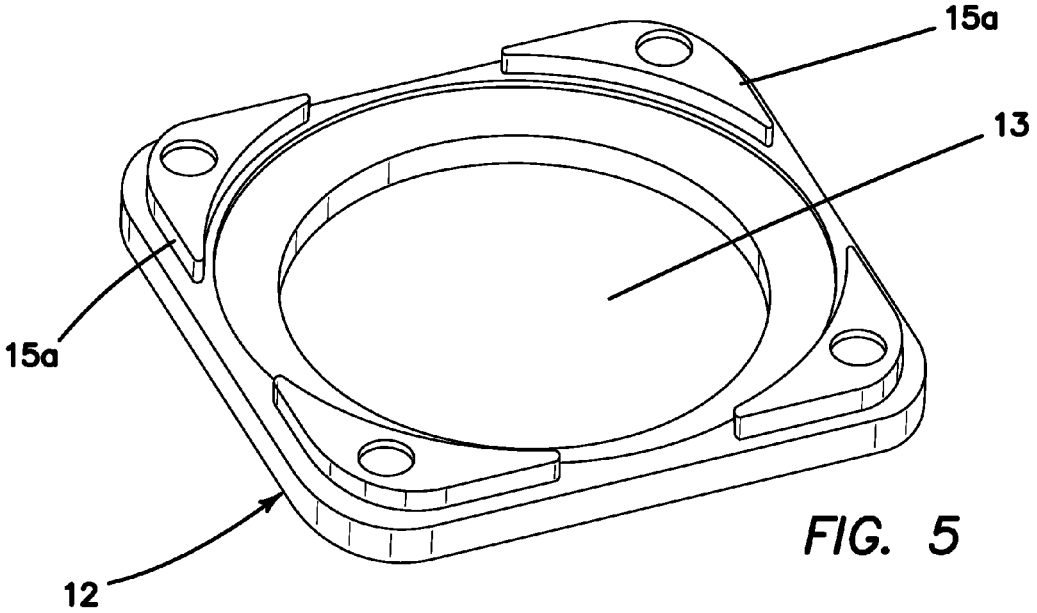
FIG. 5 is an isometric view of the base.
Figure 6:
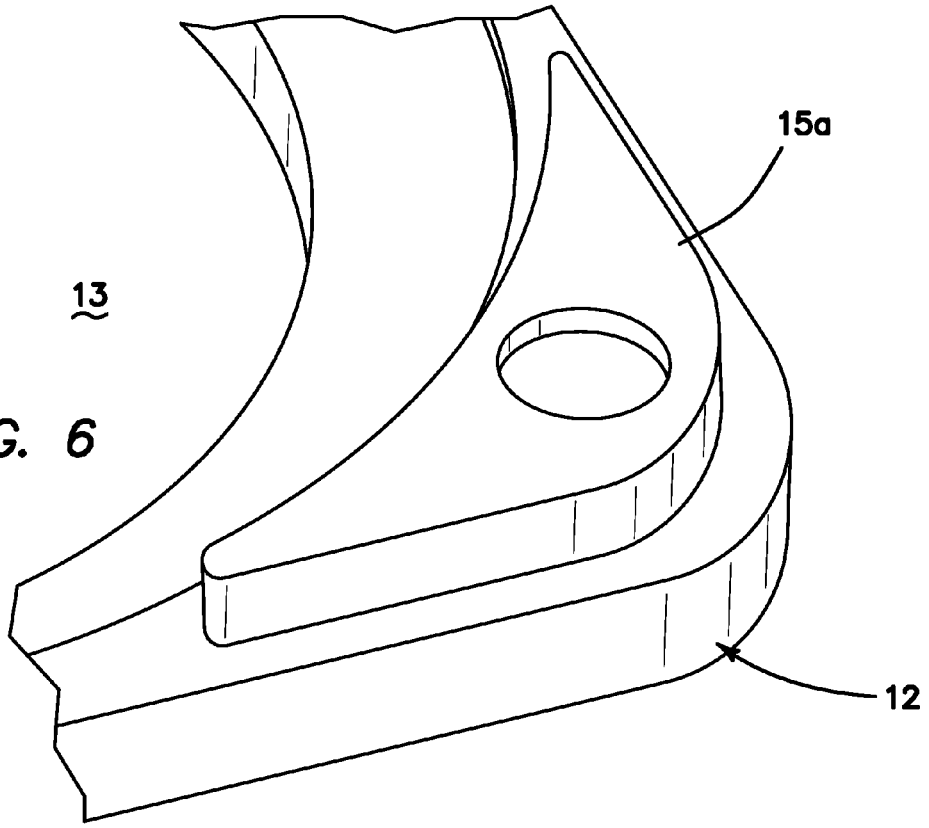
FIG. 6 is an enlarged view of a portion of the underside of the base.
Figure 7:
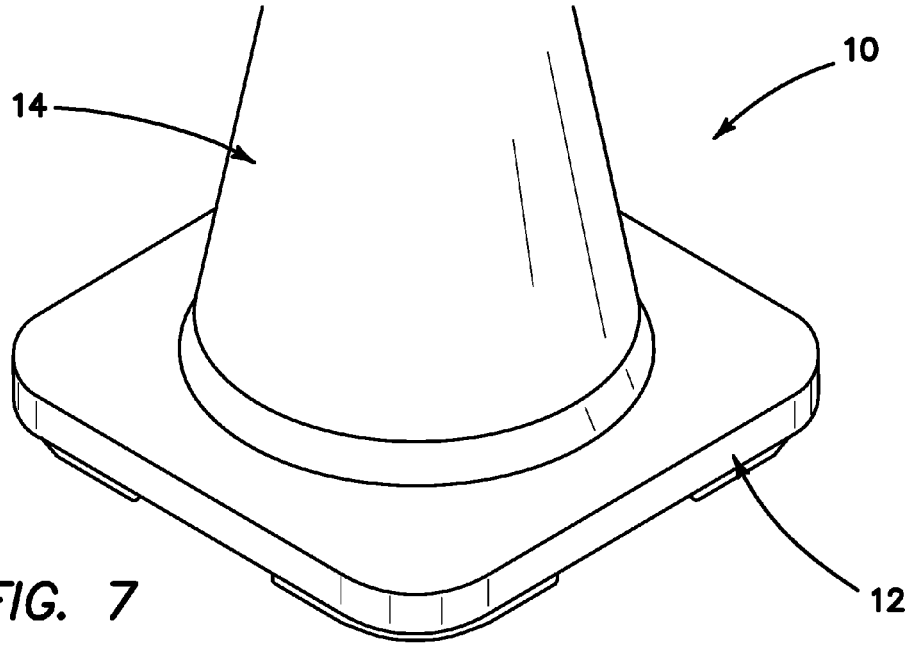
FIG. 7 is an isometric view of the base of an assembled cone.
Figure 8:
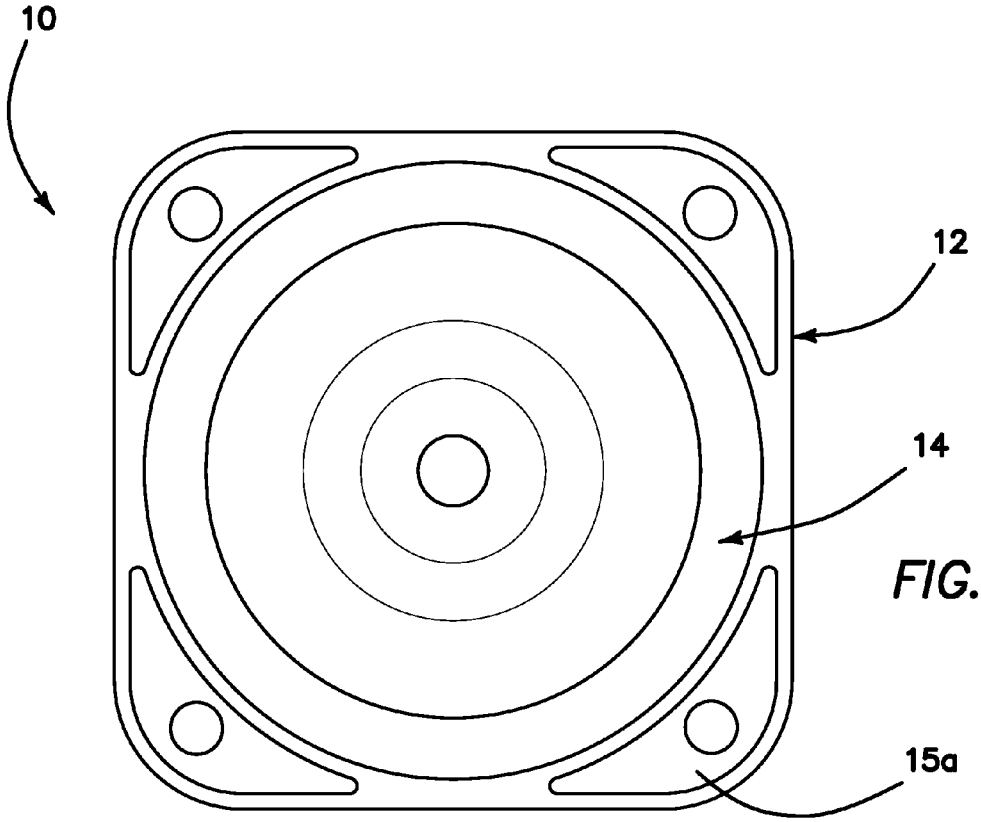
FIG. 8 is a bottom view of an assembled cone.
Figure 9:
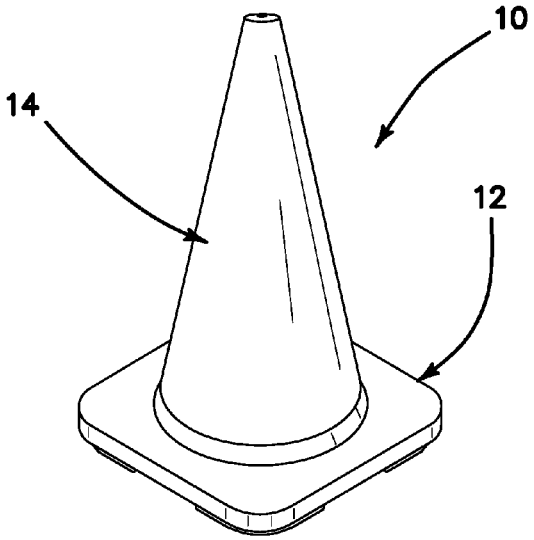
FIG. 9 is an isometric view of a complete assembled cone.
Figure 10:
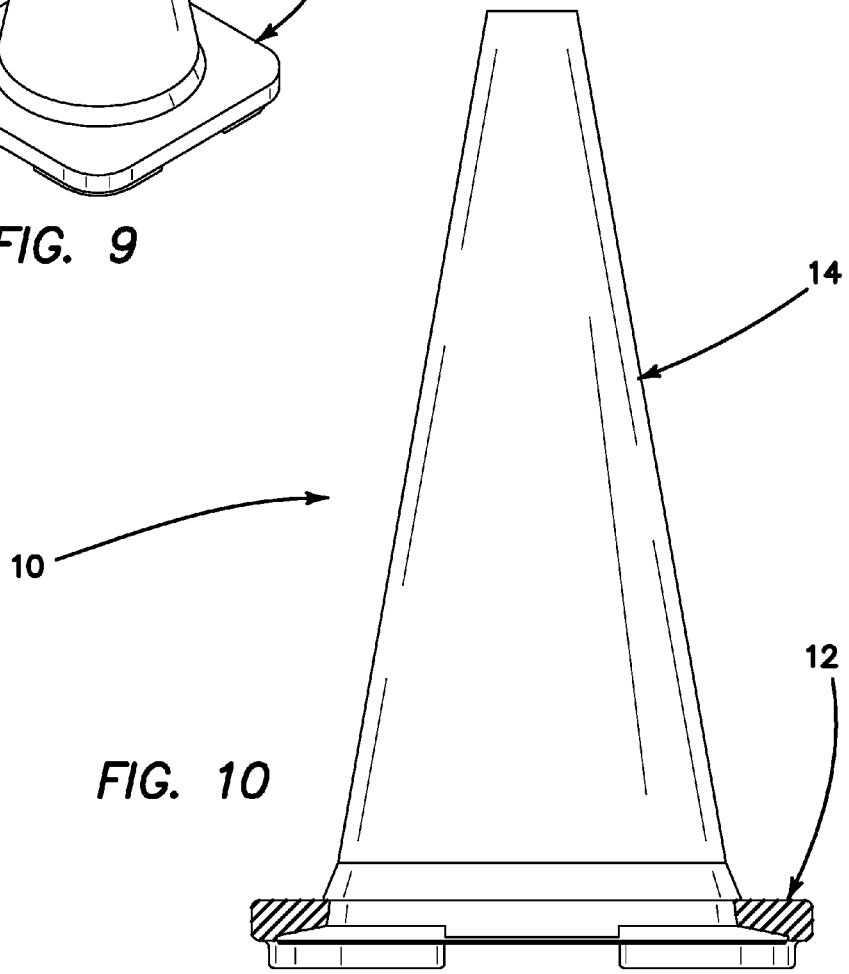
FIG. 10 is a side cross-sectional view of a complete assembled cone.
Figure 11:
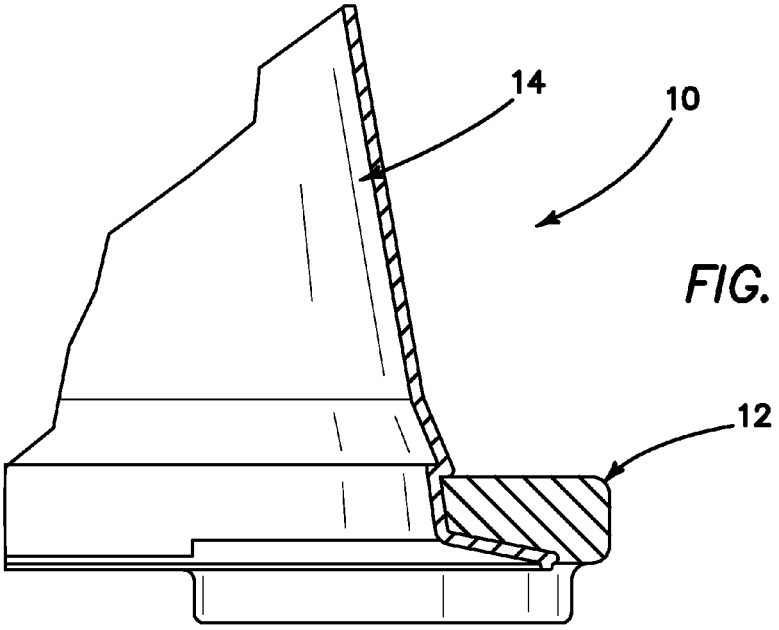
FIG. 11 is a side cross-sectional enlarged view of a portion of the base portion of a complete assembled cone.
Figure 12:
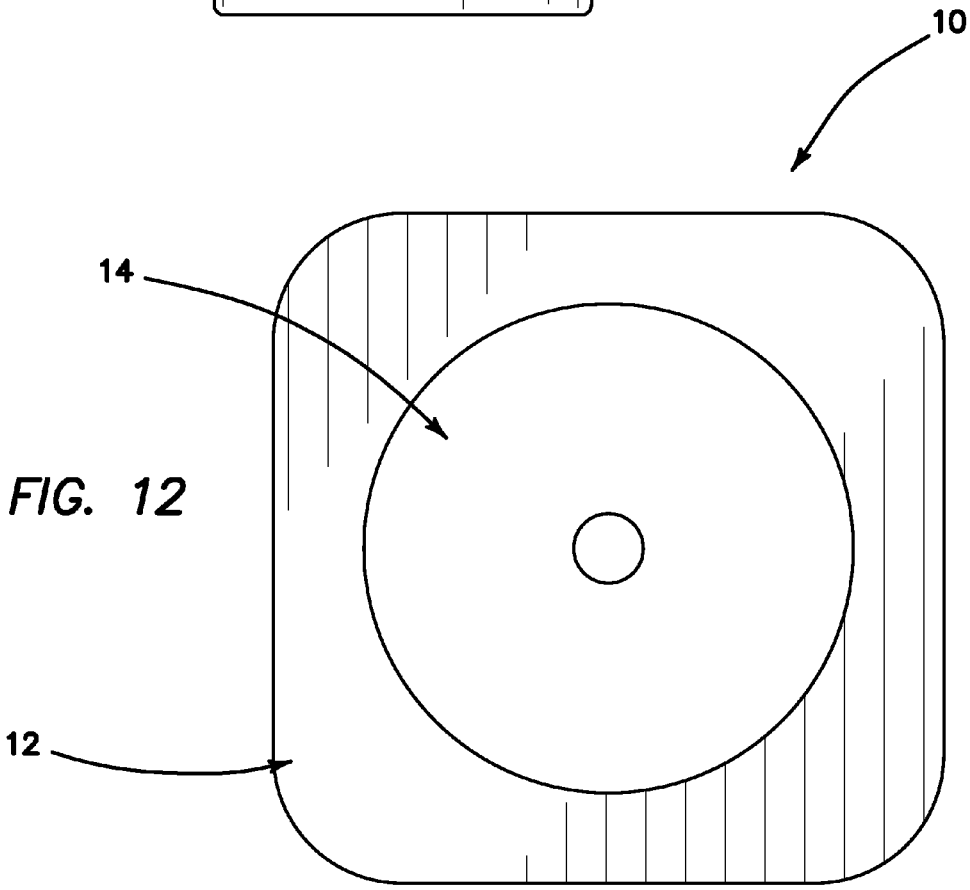
FIG. 12 is a top view of a complete assembled cone.

Referring now more particularly to the drawings, there is shown in FIGS. 1-12 a first embodiment of a traffic cone assembly 10 comprising a molded base 12 having a center aperture 13, and a conical marker body 14. The marker body 14 need not necessarily be conical in shape, though this conventional traffic marker shape is presently preferred.

The cone body 14 is preferably injection molded or blow molded of low density polyethylene or other suitable plastic. This material selection provides superior cold weather performance. It may also be molded of a blend, in whole or in part, of both high density and low density material. The base 12 is molded of recycled rubber, such as crumb rubber, though again, other suitable materials may be used. The base is designed to be weighted in accordance with desired specifications for these types of weighted traffic cones. For example, two desired embodiments might be 7 lb. and 10 lb., respectively. The assembly of cone body 14 and base 12 is adapted to be of a specified assembled height, such as 18, 28, or 36 inches, or other desired height. One particular advantage of the inventive cone assembly is that the base 12 comprises 80% of the weight of the cone, while the body or stem 14 is only 20% of the weight of the cone. In state of the art polyvinylchloride (PVC) cones, the base is typically only 60% of the total weight of the assembly. Thus, there is a substantial stability advantage in the inventive cone assembly.

A flange 15 around the bottom of the conical marker body is illustrated in FIGS. 2, 8, 10, 11, 14, 15, 16, and 17. This flange 15 controls the thickness of the base at its connection to the marker body and ensures that base feet 15*a* of the base 12 are always in contact with the ground. Another important feature is the addition of small locking and sizing diamonds around the circumference of the conical body. These diamonds compensate for base molding, dimensional variations, and assist in keeping the base and body rotationally secured in place, while also allowing the cone assembly to easily be separated into two pieces when desired.

Figure 13:
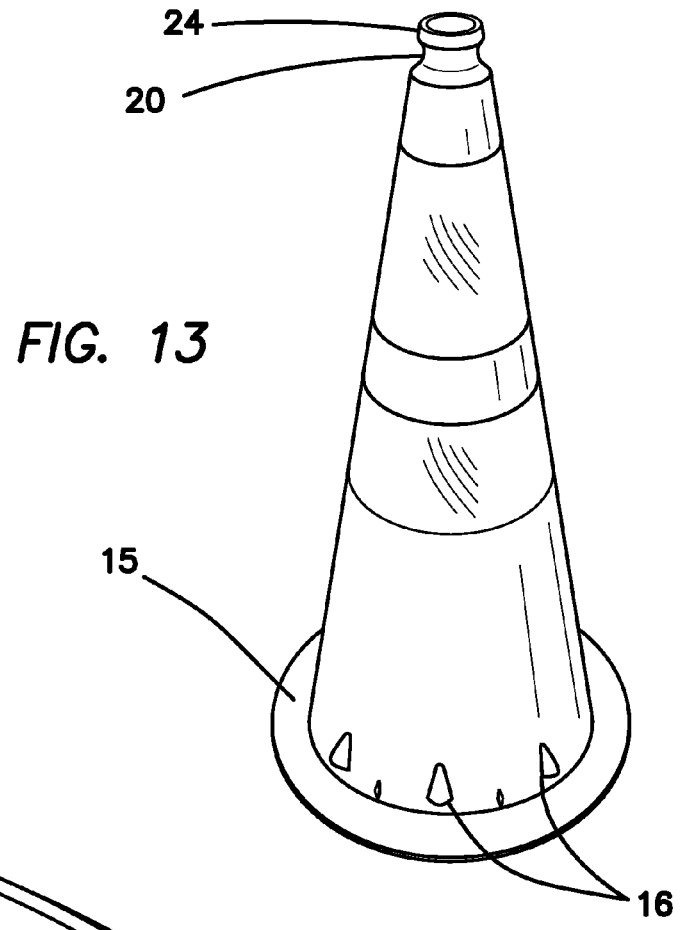
FIG. 13 is an isometric view of another embodiment of the traffic cone of the present invention.

The top of the cone body may be molded with a concave recess 20 in order to prevent slippage from an operator's hand. Additionally, the same area or the entire area of the cone body may be textured to reduce slippage. This is illustrated in FIG. 13, for example.

The cone may be made of any material, and may be molded with or printed with text on the conical marker body.

Figure 16:
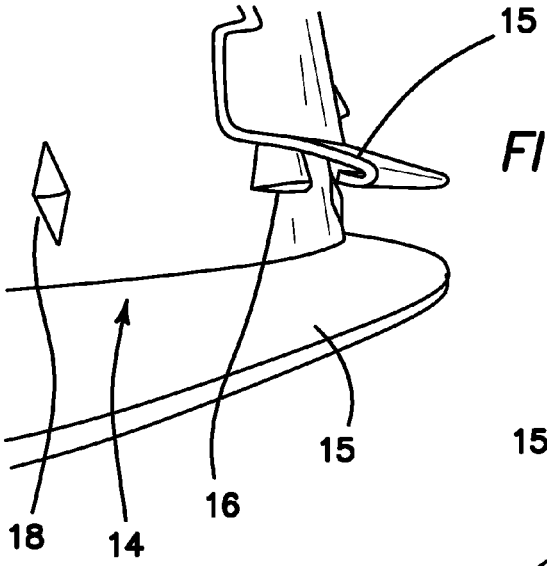
FIGS. 16-17 are views of the lower portion of the body of the traffic cone of FIGS. 13-15, wherein a second cone has been stacked atop the first one, without bases, with a portion of the second cone body cut away for illustrative purposes.
Figure 17:
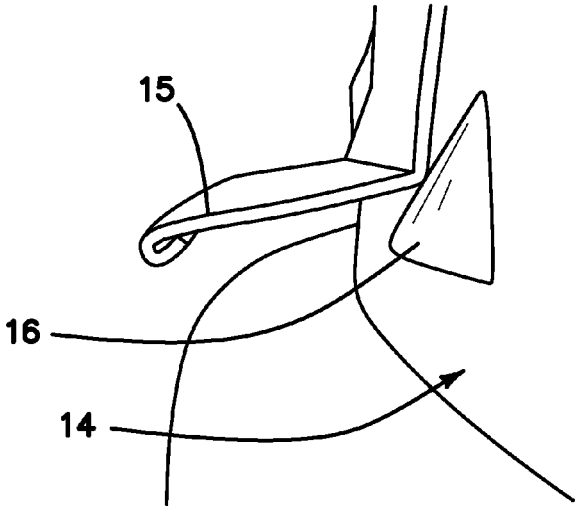

Reviewing, particularly, FIGS. 16-17, the cone stem or body is designed with a feature that causes finished cone stems without bases attached to stack such that they stop on "nubs" 16 of the inside cone stem in the stack. FIGS. 16-17 show the upper or outer cone step partially cut away so that the inside cone stem is visible, so that the contact with the nubs 16 can be seen. This interfering contact prevents the outer cone stems from making contact along the tapered face of the inner cone stems, which can cause sticking and/or scuff damage to the applied reflective sheeting.

Figure 18:
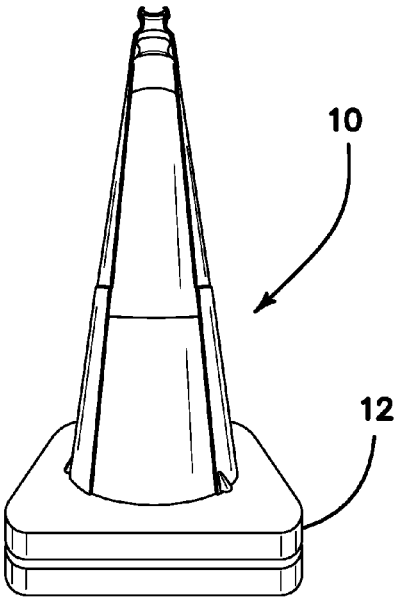
FIGS. 18-19 are views showing two cones of FIGS. 13-17 in stacked relationship, with the upper cone cut away for illustrative purposes.
Figure 19:
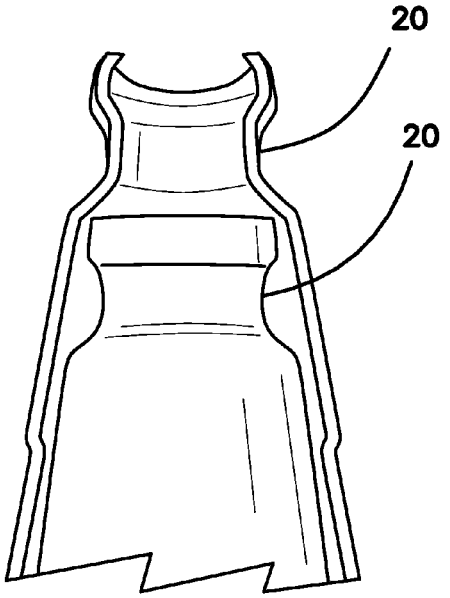

As shown in FIGS. 18 and 19, wherein the outer cone stem is also partially cut away for visual clarity, when assembled to their respective bases, the cone is designed to have a stack height defined by the height of the base and not the overall cone assembly height. This allows the cones to stack efficiently with clearance between the cone stems when shipped to the final destination without the sheeting becoming scuffed or damaged during transport, because the cone stems do not come in contact with one another in the sheeting areas. This also prevents cones from sticking to one another when stacked.

Figure 20:
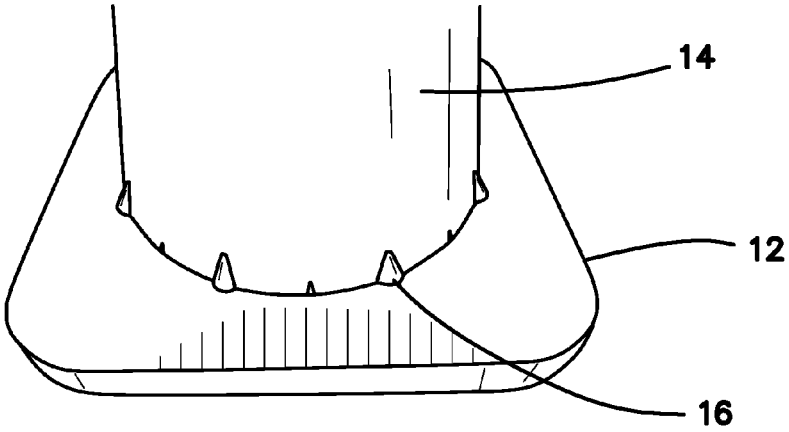
FIGS. 20-23 are views illustrating the second embodiment of the inventive traffic cone, wherein the engagement between the cone body and base are particularly shown.
Figure 21:
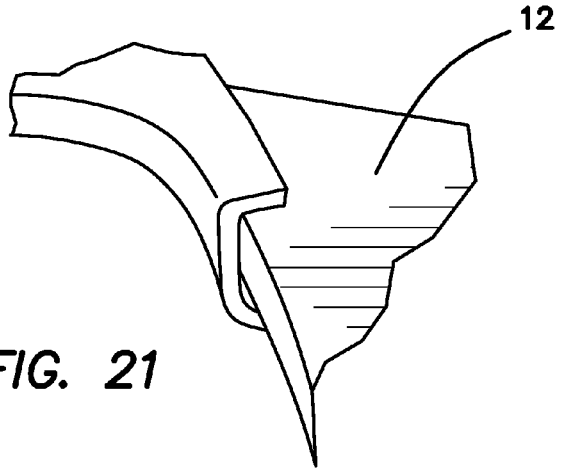

FIGS. 19 and 20 illustrate the engagement of the stacking and base engagement nubs or interlocking protrusions 16 with the base, instead of a continuous ring of molded plastic. With a continuous ring, if the locking joint were to break on a continuous ring, the base would roll off the stem in a manner similar to a tire rolling off a wheel when the bead is "rolled". With the individual nubs, if one or two of the nubs no longer seal on the base the other nubs continue to hold onto the base. Diametrical sizing diamonds 18 between the locking nubs are designed to compensate for the variable base diameters that come naturally from the crumb rubber molding processes.

Figure 22:
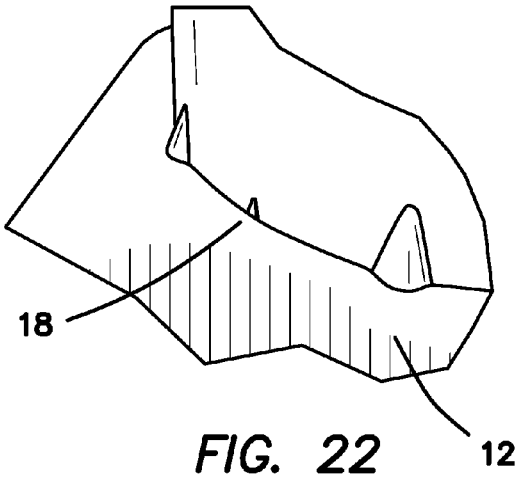
Figure 23:
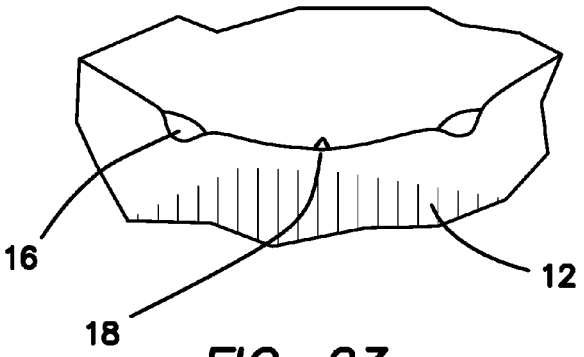

Referring to FIGS. 22-23, spaced apart compression sizing diamonds 18 improve the locking of the base to the stem by spacing the base away from the stem, causing the base to deform locally into the diamonds (increasing the interference fit of the base to the stem). The diamonds 18 function as adjusters, compensating for stem/base tolerance (holding variances in inner base diameter). The peaks of the diamonds 18 are disposed midway below the base of the nubs 16 to keep the base concentric to the conic section. The diamonds are centered between the nubs, and create a tangent though the nub contact surface.

The rubber base of the present invention is a significant advantage over the PVC base of prior art cones such as those manufactured by JBC. For example, the coefficient of friction is better on the roadway with rubber, than with a PVC plastic base, as provided, for example, by JBC Safety Plastic, having a U.S. sales office in City of Industry, Calif.

Figure 14:
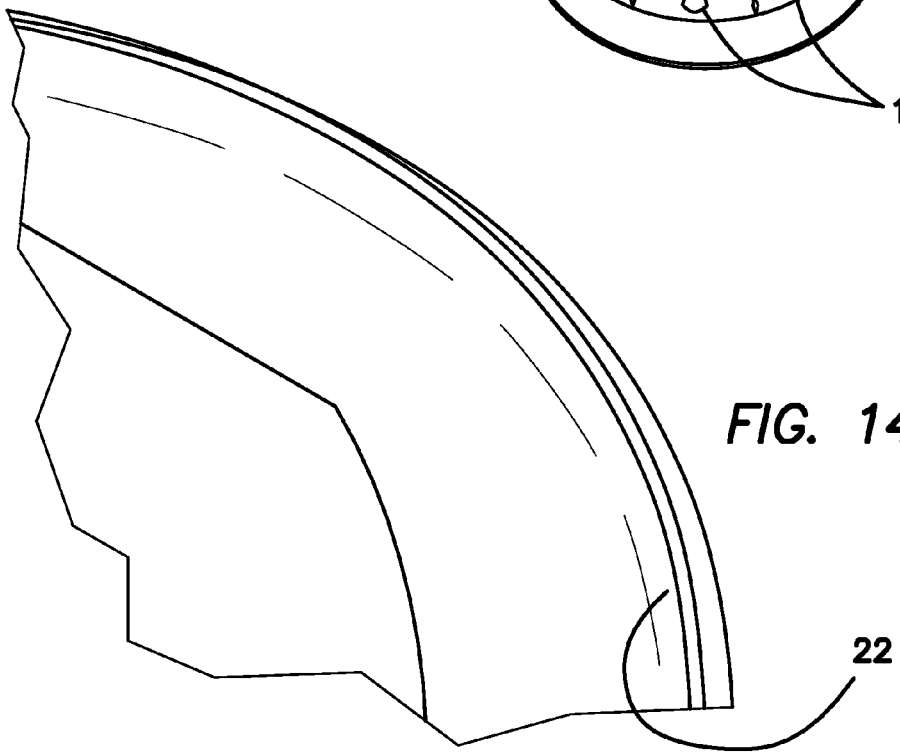
FIG. 14 is a view of the bottom inside surface of the body of the traffic cone of FIG. 13, showing the flange of the cone body with a reinforced lip.
Figure 15:
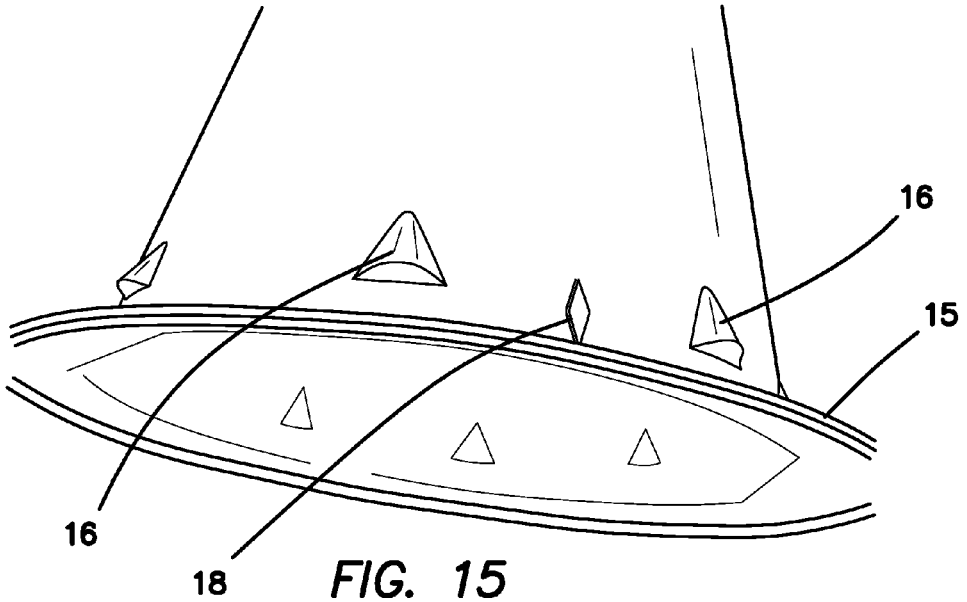
FIG. 15 is a view of the lower portion of the body of the traffic cone of FIGS. 13 and 14.

As shown in FIG. 14, double flange 22 comprises a molded inwardly turned lip for structural integrity.

At the intersection of stem and flange, long opposed shallow recesses at each parting line, differently-shaped recesses beneath each remaining nub 16, stiffen the flange.

Advantageously, the disclosed cone comprises a two-piece cone which is joinable in the field. This is unique in the art of molded PVC cones of the type disclosed. This allows for the sale and replacements of cone bodies (stems) for attachment to bases already in stock, which is cost-effective and environmentally friendly, since bases are much more durable than stems.

The recess 20 on the cone stem (FIG. 13) acts as a standoff to prevent sticking when cone stems are stacked, as shown in FIG. 19.

The inventive cone assembly, because of its separable two-piece construction, has both a heavier base and a lighter stem than prior art cones. For example, the stem is preferably molded of low density polyethylene, rather than PVC, so that a 7 lb cone comprises a stem of only 1½ lb and a base of 5½ lb. Because of the heavier base and lighter cone stem (approximately 80% of the total weight in the base), the tip angle (the angle from vertical to which the cone assembly can be tipped before falling over) is approximately 76 degrees, rather than the approximately 54 degrees typical in the industry, for prior art PVC cones where only about 60% of the total weight is in the base. This is beneficial as workers are dropping cones from vehicles to set them on a work site, as it results in far fewer failed placements (cones falling over), requiring re-setting.

The inventive cone is comprised of 80% recycled material by weight, and can be 100% recycled again. As noted above, an additional environmental advantage is that if a stem is destroyed, a new stem can be ordered and the rubber base reused.

Up stop 24 is provided for easy gripping of the top of the cone. Such an up stop doesn't typically work with soft PVC cones, because the up stop on such soft stems simply collapses when gripped. The recess 20 and up stop 24 combination also provides a convenient tie-off for caution tape and the like.

Accordingly, although an exemplary embodiment of the invention has been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A traffic marker assembly, comprising:

a marker body comprising walls formed of molded plastic, a top portion, and a base portion, the base portion comprising a circumferential flange;

a base comprising a molded material and having a center aperture therein for receiving the marker body when the marker body is joined to the base, wherein the circumferential flange of the marker body has a greater diameter than a diameter of the center aperture of the base, so that the marker body can be removably joined to the base to form the traffic marker assembly, the center aperture being defined by an interior circumference of the base;

a plurality of circumferentially spaced interlocking protrusions disposed on the wall of the marker body, the interlocking protrusions being located so that they engage the interior circumference of the base when the marker assembly is in an assembled space; and a plurality of adjusting protrusions disposed in spaced circumferential relation about the marker body, each of said adjusting protrusions being disposed between adjacent ones of said interlocking protrusions, wherein a lower end of each of said adjusting protrusions is disposed on a lower portion of the marker body walls than is a lower end of each of said interlocking protrusions.

2. The traffic marker assembly as recited in claim 1, wherein the base has a weight comprising at least 70% of a total weight of the traffic marker assembly, the marker body having a weight comprising the remaining 30% or less of the total weight of the traffic marker assembly, whereby when the traffic marker assembly is assembled, a tip angle of the traffic marker assembly is at least 60 degrees from vertical.

3. The traffic marker assembly as recited in claim 2, wherein said tip angle is at least 70 degrees from vertical.

4. The traffic marker assembly as recited in claim 2, wherein said tip angle is approximately 76 degrees from vertical.

5. The traffic marker assembly as recited in claim 2, wherein the base has a weight comprising approximately 80% of the total weight of the traffic marker assembly.

6. The traffic marker assembly as recited in claim 1, wherein the marker body is molded of low density polyethylene.

7. The traffic marker assembly as recited in claim 1, wherein the base is molded of recycled rubber.

8. The traffic marker assembly as recited in claim 1, wherein the plurality of circumferentially spaced interlocking protrusions are also located so that when a plurality of said marker bodies, without attached bases, are stacked together, the protrusions on a lower marker body interferingly contact an inner wall of a marker body stacked thereover in order to stop further advancement of the upper marker body over the lower marker body, thereby preventing sticking of the upper marker body on the lower marker body.

9. The traffic marker assembly as recited in claim 1, wherein said plurality of adjusting protrusions are diamond-shaped and function to press the base away from the marker body, thereby causing the base to deform toward the interlocking protrusions to improve locking of the base to the marker body, both axially and rotationally.

10. The traffic marker assembly as recited in claim 1, and further comprising a concave recess molded into the top portion of the marker body, for assisting in gripping of the marker body.

11. The traffic marker assembly as recited in claim 10, and further comprising a protruding circumferential up stop portion molded into the marker body above the concave recess.

12. The traffic marker assembly as recited in claim 10, wherein the surface of the marker body wall in said top portion is textured for providing an improved gripping surface.

13. A traffic marker assembly, comprising:

a marker body comprising walls formed of molded plastic, a top portion, and a base portion, the base portion comprising a circumferential flange;

a base comprising a molded material and having a center aperture therein for receiving the marker body when the marker body is joined to the base, wherein the circumferential flange of the marker body has a greater diameter than a diameter of the center aperture of the base, so that the marker body can be removably joined to the base to form the traffic marker assembly, and further wherein the center aperture is defined by an interior circumference of the base;

a plurality of circumferentially spaced interlocking protrusions disposed on the wall of the marker body, the interlocking protrusions being located so that they engage the interior circumference of the base when the marker assembly is in an assembled state, wherein the plurality of circumferentially spaced interlocking protrusions are also located so that when a plurality of said marker bodies, without attached bases, are stacked together, the protrusions on a lower marker body interferingly contact an inner wall of a marker body stacked thereover in order to stop further advancement of the upper marker body over the lower marker body, thereby preventing sticking of the upper marker body on the lower marker body; and a plurality of adjusting protrusions disposed in spaced circumferential relation about the marker body, each of said adjusting protrusions being disposed between adjacent ones of said interlocking protrusions, wherein the adjusting protrusions function to press the base away from the marker body, thereby causing the base to deform toward the interlocking protrusions to improve locking of the base to the marker body, both axially and rotationally.

14. The traffic marker assembly as recited in claim 13, and further comprising a concave recess molded into the top portion of the marker body, for assisting in gripping of the marker body.

15. The traffic marker assembly as recited in claim 14, and further comprising a protruding circumferential up stop portion molded into the marker body above the concave recess.

16. The traffic marker assembly as recited in claim 14, wherein the surface of the marker body wall in said top portion is textured for providing an improved gripping surface.

17. The traffic marker assembly as recited in claim 13, wherein the base has a weight comprising at least 70% of a total weight of the traffic marker assembly, the marker body having a weight comprising the remaining 30% or less of the total weight of the traffic marker assembly, whereby when the traffic marker assembly is assembled, a tip angle of the traffic marker assembly is at least 60 degrees from vertical.

18. The traffic marker assembly as recited in claim 17, wherein said tip angle is approximately 76 degrees from vertical.

19. The traffic marker assembly as recited in claim 17, wherein the base has a weight comprising approximately 80% of the total weight of the traffic marker assembly.

20. The traffic marker assembly as recited in claim 13, wherein the marker body is molded of low density polyethylene.

* * * * *